United States Patent [19]

Riegler et al.

[11] Patent Number: 4,813,700

[45] Date of Patent: Mar. 21, 1989

[54] SKI BINDING SCREW CONNECTION

[75] Inventors: Andreas Riegler; Karl Stritzl, both of Vienna; Hurbert Würthner, Hainburg, all of Austria

[73] Assignee: TMC Corporation, Switzerland

[21] Appl. No.: 73,681

[22] Filed: Jul. 15, 1987

[30] Foreign Application Priority Data

Jul. 15, 1986 [AT] Austria ..... 1914/86

[51] Int. Cl.[4] ..... A63C 11/00

[52] U.S. Cl. ..... 280/633; 280/611; 280/618

[58] Field of Search ..... 280/611, 617, 618, 623, 280/636, 633, 607; 411/999, 337, 353

[56] References Cited

U.S. PATENT DOCUMENTS

| | | | |
|---|---|---|---|
| 2,709,470 | 5/1955 | Knohl | 411/999 |
| 3,917,300 | 11/1975 | Salomon | 280/611 |
| 4,302,027 | 11/1981 | Himmetsberger et al. | 280/618 |
| 4,598,933 | 7/1986 | Hoelzl | 280/618 |
| 4,640,524 | 2/1987 | Sedlmair | 280/611 |

FOREIGN PATENT DOCUMENTS

| | | | |
|---|---|---|---|
| 372863 | 11/1983 | Austria | 280/611 |
| 2359489 | 6/1974 | Fed. Rep. of Germany | 280/611 |
| 2612069 | 9/1977 | Fed. Rep. of Germany | 280/628 |
| 2732099 | 2/1978 | Fed. Rep. of Germany | 280/611 |
| 2378201 | 9/1978 | France | 280/633 |
| 128844 | 4/1970 | Netherlands . | |

*Primary Examiner*—David M. Mitchell

*Attorney, Agent, or Firm*—Finnegan, Henderson, Farabow, Garrett & Dunner

[57] ABSTRACT

A screw attachment mechanism of a ski binding which is adapted to be mounted on a ski. The attachment mechanism includes a forward base plate having at least two base plate bores extending therethrough and guide rails mounted on the base plate. A pedestal frame is mounted on the guide rails and includes at least two bores aligned with the base plate bores. Screws are individually disposed within each of the aligned bores and an engagement mechanism is provided for securely retaining the screws within corresponding base plate and pedestal bores.

7 Claims, 3 Drawing Sheets

SKI BINDING SCREW CONNECTION

FIELD OF THE INVENTION

The present invention relates to a screw connection for mounting a ski binding on a ski. More particularly, the present invention relates to a ski binding having a support structure that can be attached to a ski by means of at least two screws which are retained within bores in the support structure when the ski binding is not mounted on the ski.

BACKGROUND OF THE INVENTION

Screw-type devices for retaining bindings on skis are known generally. For example, in an apparatus proposed in Published West German Patent Application DE-OS No. 235 9 489, the individual screws of the screw connection are inserted into a deformable holding device, in which the screw engages and is held therein, while the deformable holding device is locked against rotation. The German publication discloses various embodiments, each having the disadvantages that the fixture holding the screw has to undergo additional shaping, and that the deformable holding device constitutes an additional component. These factors complicate the manufacturing process and the assembly work. Indeed, increased technical effort is required because of the number of screws to be used in each particular case.

In another device disclosed in Austrian Patent AS-PS No. 372,863, shoulders are used to retain the inserted screws in their unmounted state. These shoulders each have different radii and the circles of each radii touch one another tangentially. As such, the two points of contact of the circles of the two shoulders are staggered 180 degrees from each other. Thus, the manufacturing process for mounting the shoulders is complicated, expensive, and time consuming.

The device disclosed in Published West German Patent Application DE-OS No. 273 2 099 uses a separate holding member to locate the screw. The surfaces of this holding member that are turned toward the screw head have a conical shape and have at least one longitudinal slot or a rupture joint, which produces deformation to and destruction of the holding member, so that the latter breaks off upon penetration of the screw, or at least can be removed with ease. Therefore, the use of an additional component also is necessary. Unlike other conventional devices, however, this additional component does not require the separate holding member after assembly of the device. With respect to improvements in the conventional devices, reference is made to Published West German Patent Application DE-OS No. 273 2 099, particularly to Dutch patent NL-PS No. 128,844.

It has also become known from Published West German Patent Application DE-OS No. 261 2 069 to provide the two sole-immobilizing means with a throughhole for a tool, e.g., for a screw driver, in order to operate the fastening screws in the front jaws.

OBJECTS AND SUMMARY OF THE INVENTION

An object of the present invention is to provide a device which is less complex both in terms of fabrication and mounting, and in which a screw is used for fastening a ski-binding element securely onto a ski without additional components, such as specially constructed attachment fixtures.

Another object of the present invention is to provide a device in which the screws prevent a pedestal body from moving in relation to a base plate of the ski binding during transportation and mounting of the ski binding.

To achieve these and other objects, and in accordance with the purpose of the invention, a device for attaching a ski binding comprises a base plate for attachment to a ski having two or more bores; a pedestal body having two or more bores designed so that the bores ay be aligned with the bores in the base plate; and connecting means, such as screws, securely mounted in each bore in such a way that the screws will be supported within the bore during transportation and assembly.

Because each screw is held in the pedestal body bore the pedestal body is locked against resetting and vibration relative to the base plate during the time of transportion and during assembly. Thus, the ski-bindings can be mounted at once by insertion and operation of a mounting tool, especially if the screws are designed as self-tapping screws in a manner generally known. Further, when drilling the bores in the base plate, a thread can be tapped at once, so that the individual screws are prevented from falling out.

The accompanying drawings, which are incorporated in and constitute a part of this specification, illustrate several embodiments of the invention and, together with the description, serve to explain the principles of the invention.

DESCRIPTION OF THE PREFERRED EMBODIMENT

Figure 1:
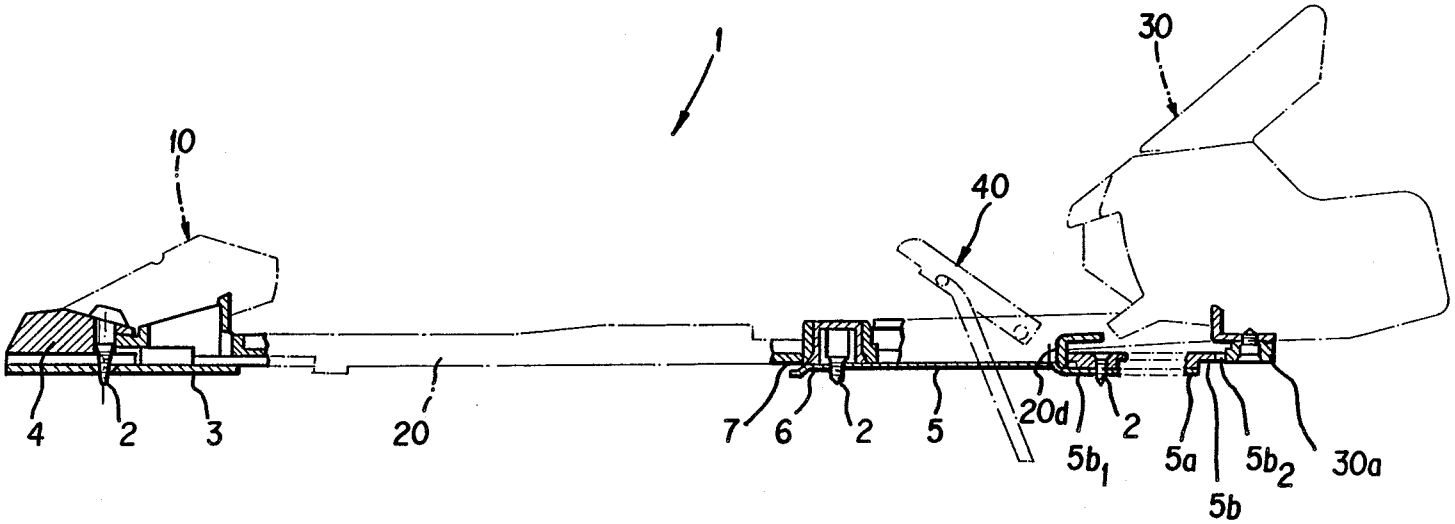
FIG. 1 shows, in longitudinal section, ski-binding elements of the present invention, in which the front element is shown in a cross-sectional view taken along the line I—I in FIG. 3.
Figure 2:
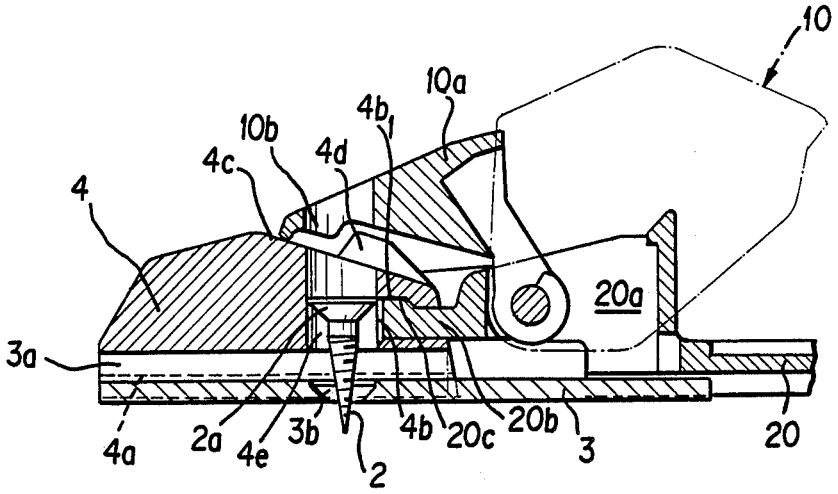
FIG. 2 is a cross-sectional view taken along the line I—I in FIG. 3.
Figure 3:
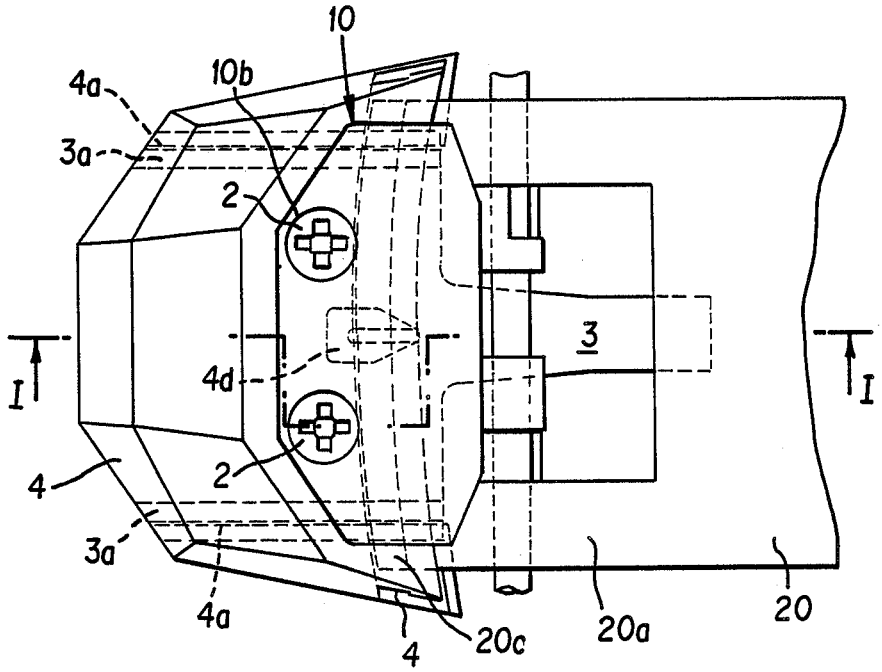
FIG. 3 is a top view of FIG. 2, in which the sole-immobilizing means. has been omitted.

As shown generally in FIGS. 1 through 3, a ski binding denoted generally by reference numeral 1, includes a base plate 3 for mounting on a ski by connecting means, such as screws 2. The ski binding 1 includes a front jaw 10 as a first ski binding element and a mounting plate 5 for a foot plate 20 which swivels about a vertical axis. The base plate 3 includes bores **3*b* for receiving each of the screws 2 and upwardly projecting guide rails 3*a* extending on both sides of the base plate 3 in the direction of the ski axis. As viewed together in FIGS. 2 and 3, a pedestal body 4 is mounted on base 3 so as to be longitudinally displaceable, but not liftable from base plate 3, with the lateral members 4*a* of the pedestal body 4 clasping around, or crossing under, the guide rails 3*a* of the base plate 3, as depicted in FIGS. 2 and 3. On the shoe-side end portion of the pedestal body 4 is a guide slot 4*b* running parallel to the ski surface and extending perpendicularly to the ski's longitudinal axis. The guide slot 4*a* has on its front end an upwardly directed enlargement $4b_1$. On the top side of the pedestal body 4 there is formed a downwardly and rearwardly inclining bearing surface 4*c*. A control lug 4*d*** rises in the area of the longitudinal axis of the bearing surface 4c. Bores 4e for the screws 2 are provided in the pedestal body 4 and are aligned with the bores 3b in the base plate 3, when the ski binding 1 is ready to be fitted on a ski (not shown).

As shown in FIG. 1, the foot plate 20 is swivel-mounted on a pivot 5. The front end of the foot plate 20 is formed as a bearing block 20a for supporting the front jaw 10 and a control member 10a of the front jaw 10. The control member 10a is provided with bores 10b for receiving the screws 2; the bores 10b being aligned with the bores 4e in the pedestal body 4 and with the bores 3b in the base plate, that is, when the ski binding is ready to be fitted on the ski.

The front area of the bearing block 20a includes a shoulder 20b having cross section in the form of a laterally inverted horizontal letter L. The shoulder 20b of the bearing block 20a is engaged with the guide slot 4b of the pedestal body 4. Further, an upwardly projecting part 20c of the shoulder 20b extends into the enlarged section $4b_1$ of the guide slot 4b.

The pivot 6 is fixedly connected to the mounting plate 5 and supports the foot plate 20 by a sleeve 7. The rear area of the mounting plate 5 is formed as a guide for the foot plate 20, when the foot plate 20 is pivoted or swivelled. An intermediate element 5a and a cam element 5b are formed as a holding rail $5b_1$, which engages a holding element 20d having a substantially U-shaped cross section that is connected to the foot plate 20. The rear area of the cam element 5b is designed as cam $5b_2$ for a heel grip 30 attached to the foot plate 20 and serving as a second ski-binding part. The cam element 5b cooperates with a steering roll 30a connected to the heel grip 30.

Figure 4:
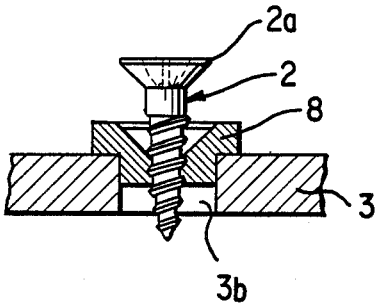
FIGS. 4 to 7 show details of other embodiments of the ski binding incorporating the invention.
Figure 5:
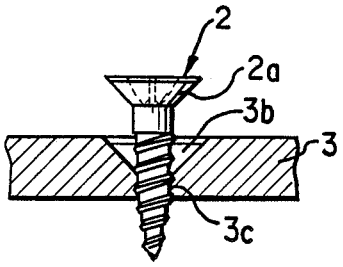
Figure 6:
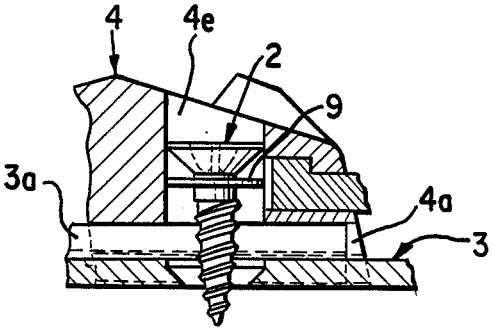
Figure 7:
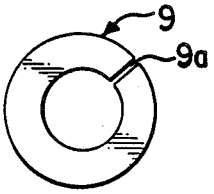

As is apparent from FIG. 2, in order to mount the base plate 3, the screws 2 are inserted into the bores 4e of the pedestal body 4 and in the bores 3b of the base plate in such a way as to prevent the pedestal body 4 from moving in relation to the base plate 3 while transporting or mounting the ski binding 1. In order to prevent the screws 2 from falling out of the bores 4e or 3b, the diameters of the heads 2a of the screws 2 are adjusted to the diameter of the bores 4e . The holding of the screws 2 in the bores 4e of the pedestal body 4 may also be secured in the area of the shafts of the individual screws 2. In this case, the individual bores 4e in the pedestal body 4 (as shown in FIG. 6) are provided with disk-shaped elements 9 from a deformable material. Because the disk shaped elements 9 each have a slot 9a (see FIG. 7), the tapping of the screws 2 can be effected without extra expenditure of energy. However, the bores 3b in the base plate 3 may include threads 3c in order thereby to prevent the screws 3 from falling out (see FIG. 5). It is also be possible to lock the screws 2 in the bores 3b of the base plate 3 by inserting suitable bushings or sleeves 8 into the bores (see FIG. 4). The bushings or sleeves 8 may then be provided with threads for the screws 2, but this step is unnecessary if self-tapping screws are employed.

It will be apparent to those skilled in the art that modifications and variations can be made in the ski binding attachment mechanism of the present invention without departing from the scope or spirit of the invention. It is intended that the present invention cover the modifications and variations provided that they come within the scope of the appended claims and their equivalents.

What is claimed is:

1. An attachment mechanism of a ski binding comprising:

elongated support means for the ski binding including a forward base plate, a rear mounting plate, and a foot plate connecting said base plate and said mounting plate, said base plate having at least two base plate bores extending therethrough, said support means also including guide means disposed on said base plate;

control means mounted on said support means and including a bearing block fixed to said foot plate, a control member pivotally mounted on said bearing block, and a pedestal frame displaceably mounted on said guide means said pedestal frame being releasably engaged to said bearing block and including at least two pedestal bores extending therethrough, said at least two pedestal bores corresponding in number to and having a common axis with said corresponding ones of said at least two base plate bores, said common axis extending substantially perpendicular to said base plate and;

screw means aligned along said common axis and disposed within each of said corresponding base plate and pedestal bores for preventing movement of said pedestal frame relative to said base plate, said screw means including individual screws each having engagement means for securely retaining individual ones of said screws within each of said corresponding base plate and pedestal bores.

2. The attachment means as defined in claim 1, wherein said pedestal bores each include a wall having a common diameter and wherein said engagement means includes a circular screw head formed on each of said screws, said screw heads each having a diameter substantially identical to said common diameter, so that a circumferential periphery of each said screw head frictionally engages said wall of each of said pedestal bores.

3. The attachment means as defined in claim 1, wherein each of said base plate bores is threaded and wherein said engagement means includes threads formed on each of said screws, each of said screws being threadably mated with said corresponding base plate bores.

4. The attachment means as defined in claim 1, wherein said engagement means includes sleeve means formed within each of said base plate bores for engaging each of said screws.

5. The attachment means as defined in claim 4, wherein said sleeve means includes threaded bushings formed within at least a portion of each of said base plate bores for threadably receiving said screws.

6. The attachment means as defined in claim 4, wherein said sleeve means includes bushings formed within at least a portion of each of said base plate bores, said screws being screw-tapped into said bushings.

7. The attachment means as defined in claim 1, wherein said engagement means includes annular discs for holding each of said screws, said discs being sized to be frictionally mounted within each of said pedestal bores, said discs including a radially extending slot for flexibly positioning said discs within each of said pedestal bores.

* * * * *